US007436126B2

(12) United States Patent
Yang

(10) Patent No.: US 7,436,126 B2
(45) Date of Patent: Oct. 14, 2008

(54) RESONANT BALLAST CIRCUIT

(75) Inventor: Ta-yung Yang, Milpitas, CA (US)

(73) Assignee: System General Corp., Taipei Hsien (TW)

( * ) Notice: Subject to any disclaimer, the term of this patent is extended or adjusted under 35 U.S.C. 154(b) by 140 days.

(21) Appl. No.: 11/608,080

(22) Filed: Dec. 7, 2006

(65) Prior Publication Data

US 2008/0136345 A1 Jun. 12, 2008

(51) Int. Cl.
*H05B 37/02* (2006.01)

(52) U.S. Cl. ..... 315/224; 315/219; 315/307; 315/DIG. 5

(58) Field of Classification Search ..... 315/291, 315/224, 307, DIG. 5, DIG. 7, 219, 222, 315/221

See application file for complete search history.

(56) References Cited

U.S. PATENT DOCUMENTS 7,084,580 B2 * 8/2006 Muramatsu et al. ..... 315/219
7,157,863 B2 * 1/2007 Eckert ..... 315/224

* cited by examiner

*Primary Examiner*—David H Vu
(74) *Attorney, Agent, or Firm*—J.C. Patents

(57) ABSTRACT

A low cost ballast circuit for fluorescent lamp is provided. A fluorescent lamp is connected in series with a resonant circuit having a transformer. A first switch and a second switch are coupled to switch the resonant circuit. A first winding of the transformer is connected in series with a capacitor to form the resonant circuit. A second winding and a third winding of the transformer are used for generating control signals in response to a switching current of the resonant circuit. The first switch and the second switch are controlled in response to the control signals. Furthermore, soft switching operation for the first switch and the second switch can be achieved by the present invention.

13 Claims, 5 Drawing Sheets

RESONANT BALLAST CIRCUIT

BACKGROUND OF THE INVENTION

1. Field of the Invention

The present invention relates in general to a switching circuit, and more particularly, to a switching circuit of a ballast.

2. Description of Related Art

Fluorescent lamps are one of the most popular light sources in our daily lives. Improving the efficiency of fluorescent lamps saves energy significantly. Therefore, in recent developments, the improvement of the efficiency and power savings for the ballast of the fluorescent lamps are the major issues. FIG. 1 shows a conventional electronic ballast circuit in series connection with a resonant circuit. A half-bridge inverter consists of a first switch 10 and a second switch 20. The two switches 10 and 20 are complementarily switched on and off with 50% duty cycle at a desired switching frequency. The resonant circuit is composed of an inductor 70, a capacitor 75 to operate a fluorescent lamp 50. A capacitor 55 connected in parallel with the fluorescent lamp 50 operates as a start-up circuit. Once the fluorescent lamp 50 is turned on, the switching frequency is controlled to produce a required lamp voltage. The drawback of this ballast circuit is higher switching losses on the switches 10 and 20. The parasitic devices of the fluorescent lamp 50, such as the equivalent capacitance, etc., vary in response to temperature variations and the age of the fluorescent lamp 50. Besides, the inductance of the inductor 70 and the capacitance of the capacitor 75 also vary during mass production of the ballast circuit.

SUMMARY OF THE INVENTION

The present invention provides a ballast circuit for fluorescent lamps. A resonant circuit is formed by a capacitor and a transformer connected in series. The resonant circuit is used to operate the fluorescent lamp. A first control circuit and a second control circuit are coupled to switch the resonant circuit. A first winding of the transformer is connected in series with the fluorescent lamp. A second winding and a third winding of the transformer are used for respectively generating a first control signal and a second control signal in response to a switching current of the resonant circuit. Taking the first control circuit for instance, once the first control signal is higher than a first threshold, a first switch is turned on. After a quarter resonant period of the resonant circuit, the first switch is turned off once the first control signal is lower than a second threshold. Therefore, a soft switching operation for the first switch is achieved. The second control circuit operates the same way as the first control circuit to achieve the soft switching operation for a second switch.

An objective of the present invention is to provide a ballast circuit that can automatically achieve soft switching for reducing the switching losses and improving the efficiency of the ballast circuit.

Another objective of the present invention is to develop a lower cost circuit with higher performance in efficiency.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention.

FIG. 4~FIG. 7 respectively shows a first operation phase to a fourth operation phase of the ballast circuit, according to the embodiment of the present invention.

Figure 8:
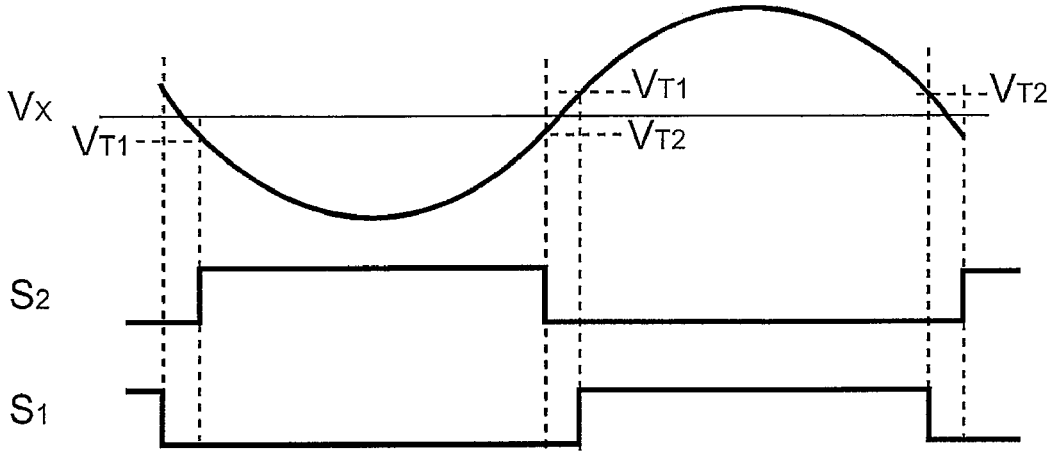

FIG. 8 shows a plurality of waveforms of the ballast circuit according to the present invention.

Figure 9:
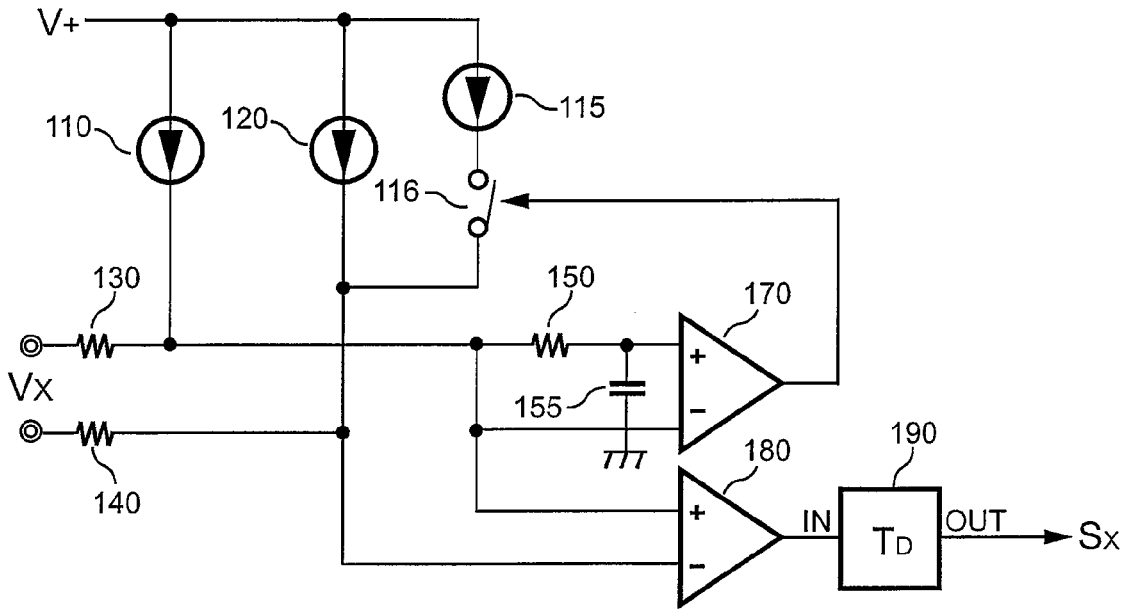

FIG. 9 shows a control circuit according to an embodiment of the present invention.

Figure 10:
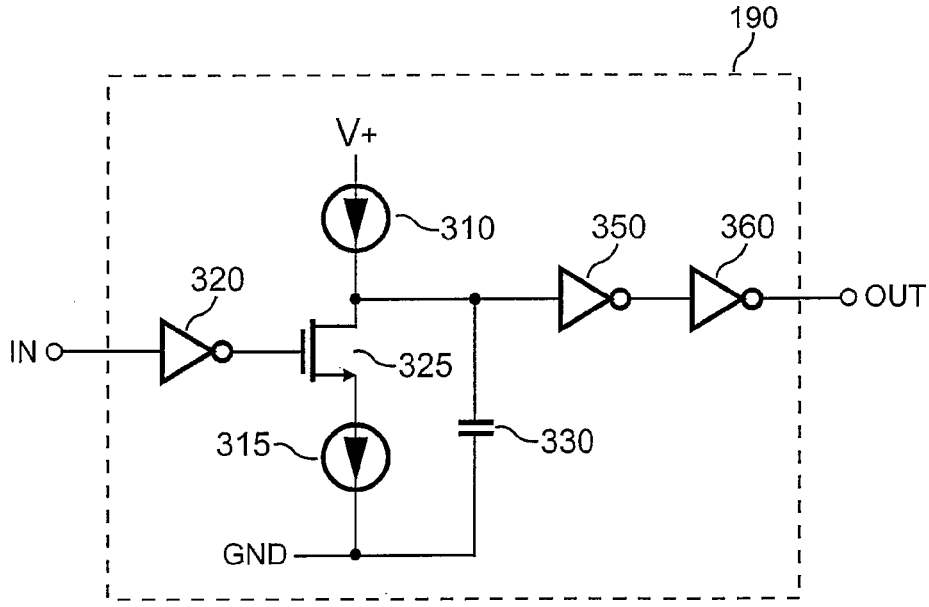

FIG. 10 shows a debounce circuit according to an embodiment of the present invention.

DESCRIPTION OF THE PREFERRED EMBODIMENT

Figure 1:
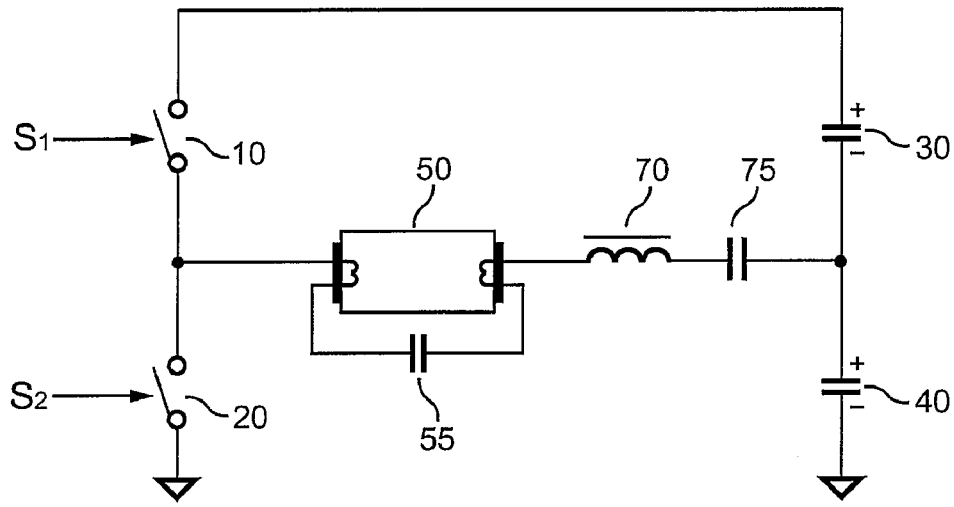
FIG. 1 (Prior Art)
FIG. 1 shows a conventional electronic ballast circuit.
Figure 2:
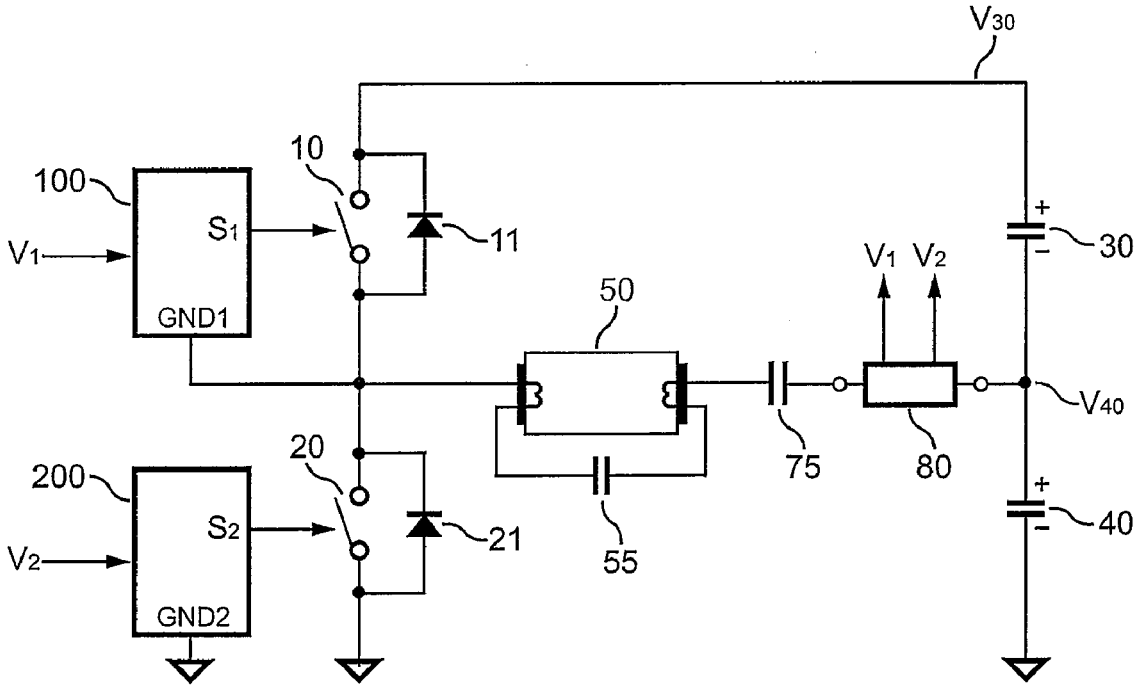
FIG. 2 is a schematic circuit of a ballast circuit according to an embodiment of the present invention.

FIG. 2 shows a schematic circuit of a ballast circuit according to an embodiment of the present invention. A capacitor 75 and a transformer 80 are connected in series to form a resonant circuit. The resonant circuit produces a sine wave current to operate a lamp 50, which is a fluorescent lamp in an embodiment of the present invention. A first switch 10 is coupled to the resonant circuit to supply a first voltage $V_{30}$ to the resonant circuit. The first switch 10 is controlled by a first switching signal $S_1$. A second switch 20 is coupled to the resonant circuit to supply a second voltage $V_{40}$ to the resonant circuit. The second switch 20 is controlled by a second switching signal $S_2$.A first winding of the transformer 80 is connected in series with the capacitor 75 to form the resonant circuit.

Figure 3:
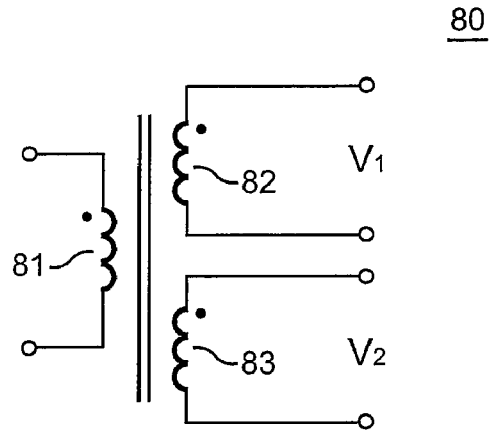
FIG. 3 shows the windings of a transformer.

FIG. 3 shows a plurality of windings of the transformer 80. A second winding 82 and a third winding 83 of the transformer 80 are used for respectively generating a first control signal $V_1$ and a second control signal $V_2$ in response to a switching current of the resonant circuit. A first winding 81 of the transformer 80 is connected in series with the lamp 50 to detect the switching current. As shown in FIG. 2, a first diode 11 is connected in parallel with the first switch 10, and a second diode 21 is connected in parallel with the second switch 20. A first control circuit 100 is used to generate the first switching signal $S_1$ for turning on/off the first switch 10 in response to the first control signal $V_1$. A second control circuit 200 is used to generate the second switching signal $S_2$ for controlling the second switch 20 in response to the second control signal $V_2$.

Figure 4:
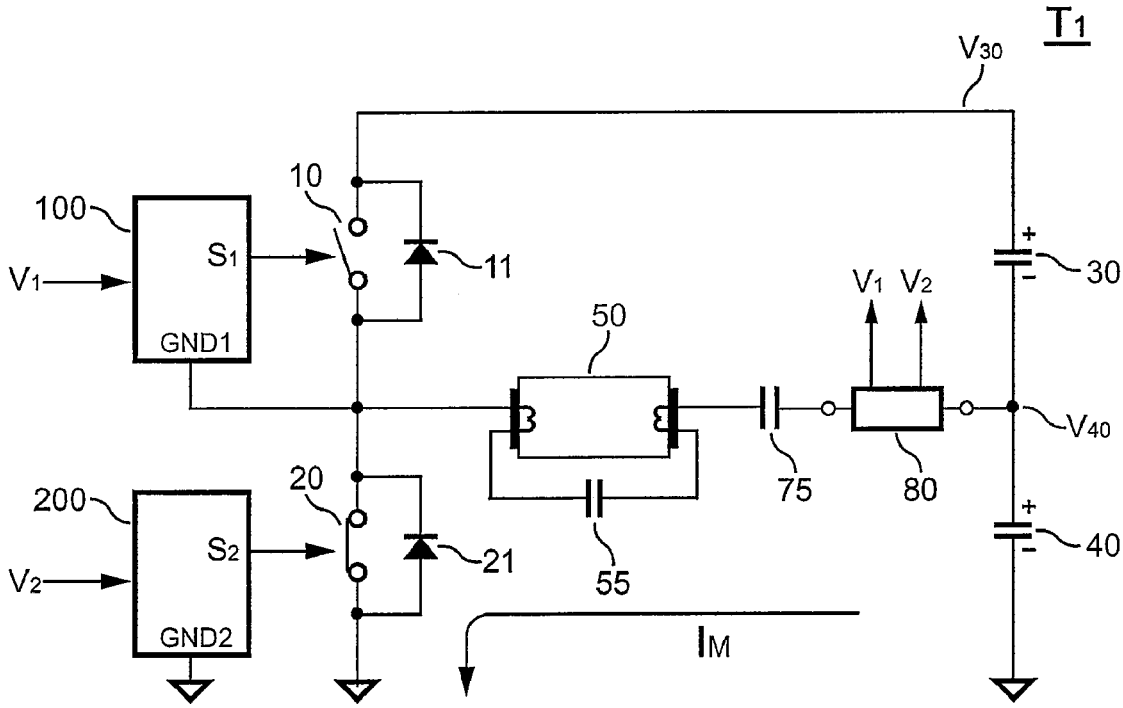
Figure 5:
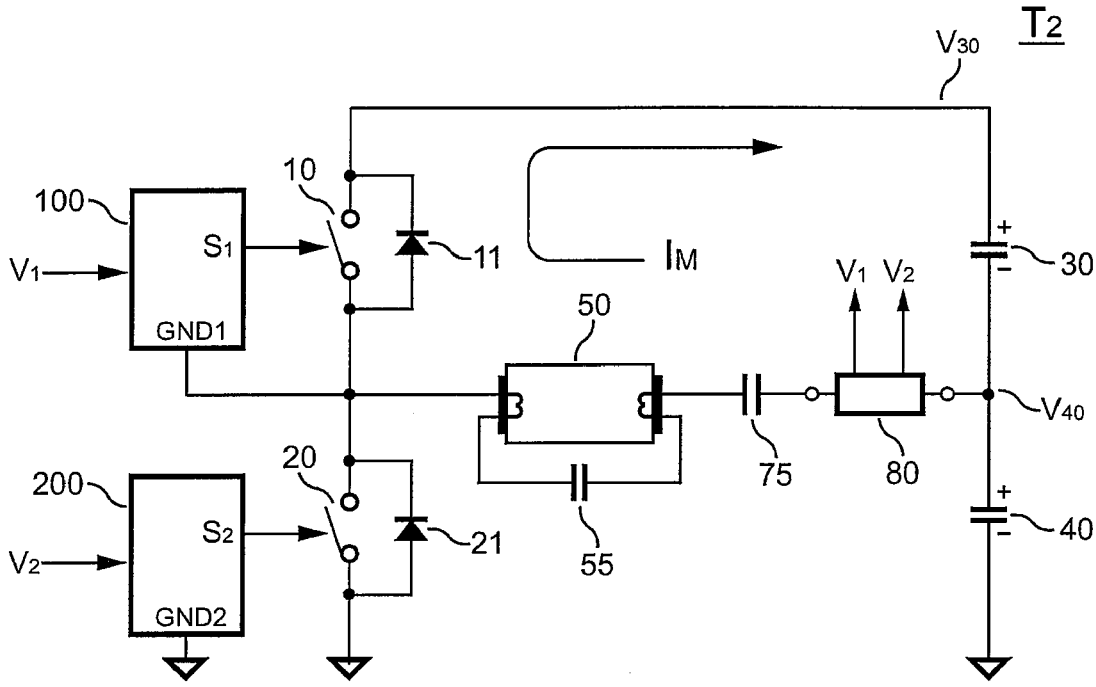
Figure 6:
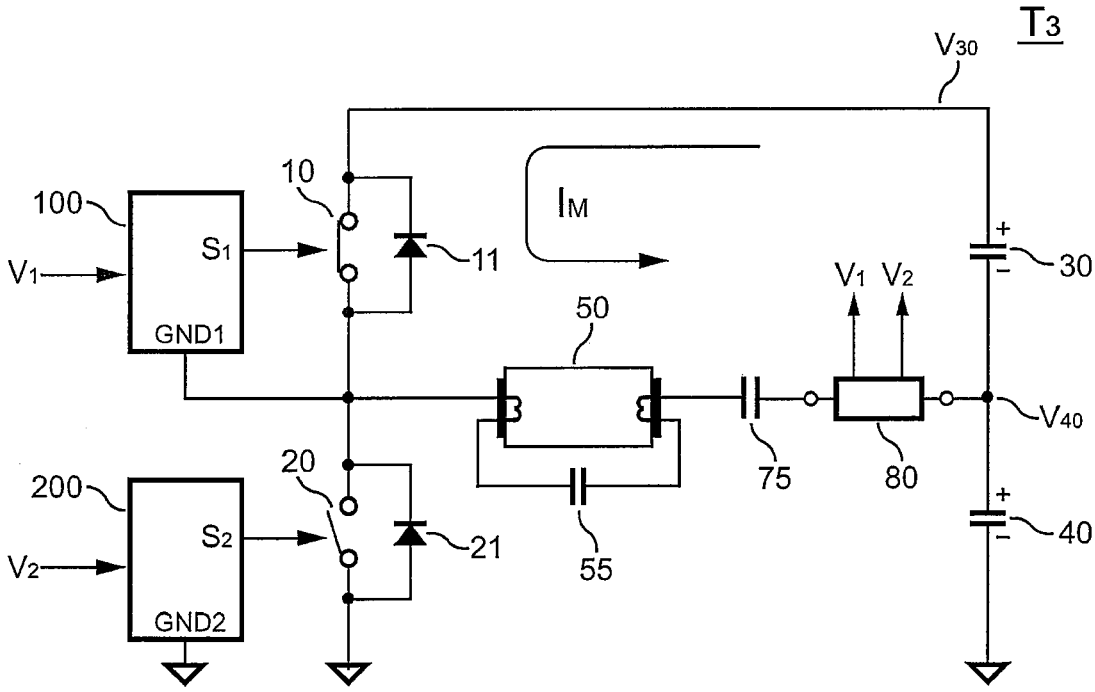
Figure 7:
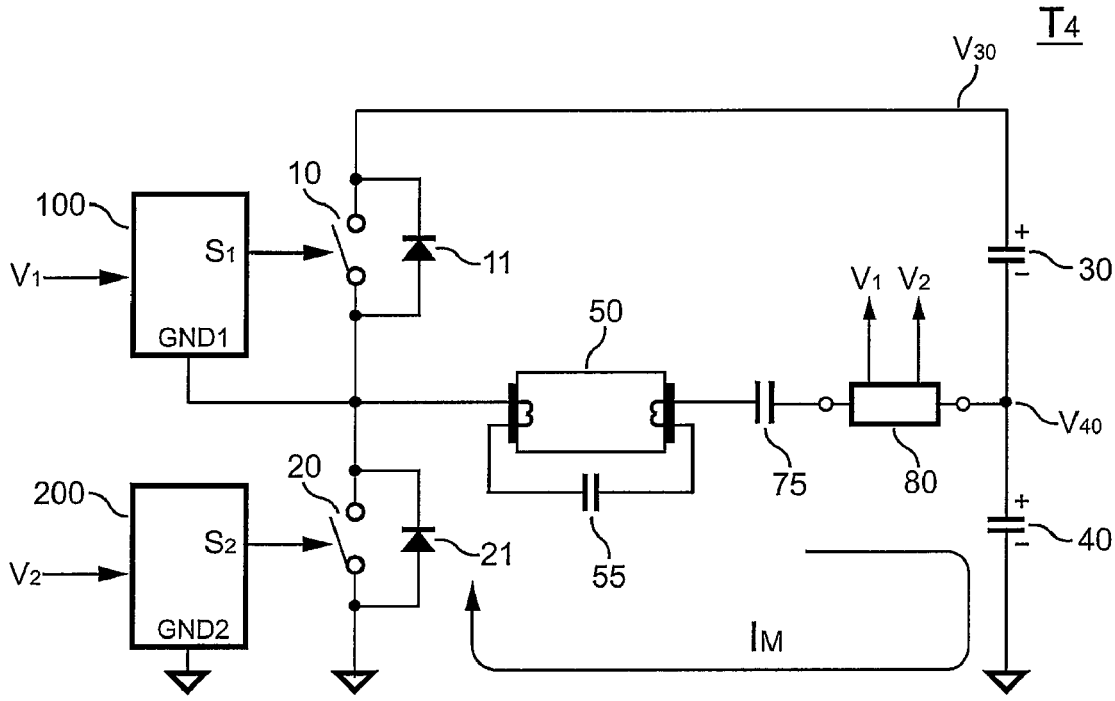

FIG. 4~FIG. 7 respectively shows four operation phases of the ballast circuit according to an embodiment of the present invention. FIG. 4 shows the first operation phase $T_1$. A lamp current $I_M$ flows via the transformer 80 to generate the second control voltage $V_2$ as the second switch 20 is turned on. Once the lamp current $I_M$ decreases and the second control voltage $V_2$ reduces to be lower than a second threshold $V_{T2}$, the second switch 20 is then turned off. After that, as shown in FIG. 5, a circular current of the resonant circuit turns on the first diode 11. The circular current is provided by the energy stored in the transformer 80. The energy of the resonant circuit is reversely charged to a capacitor 30 (the second operation phase $T_2$). The lamp current $I_M$ flowing via the transformer 80 shall generate the first control signal $V_1$. If the first control signal $V_1$ is higher than a first threshold $V_{T1}$, the first control circuit 100 shall enable the first switching signal $S_1$ to turn on the first switch 10. As shown in FIG. 6, since the first diode 11 is being conducted at this moment, the first switch 10 is turned on, which achieves soft switching operation for the first switch 10 (the third operation phase $T_3$). The lamp current $I_M$ flows into the resonant circuit from the capacitor 30 after the circular current of the resonant circuit is reversed. When the lamp current $I_M$ decreases and the first control voltage $V_1$ reduces to be lower than the second threshold $V_{T2}$, the first switch 10 is then turned off. Meanwhile, the circular current of the resonant circuit turns on the second diode 21, and the energy of the resonant circuit is reversely charged to a capacitor 40 (the fourth operation phase $T_4$). Therefore, the second switch 20 is turned on, which also achieves soft switching operation for the second switch 20.

FIG. 8 shows a plurality of waveforms of the operation phases of the ballast circuit. A signal $V_X$ represents the first control signal $V_1$ and the second control signal $V_2$. The first switching signal $S_1$ is enabled once the first control signal $V_1$ is higher than the first threshold $V_{T1}$. After a quarter resonant period of the resonant circuit, the first switching signal $S_1$ is disabled once the first control signal $V_1$ is lower than the second threshold $V_{T2}$. A resonant frequency $f_R$ of the resonant circuit is given by, $$f_R = \frac{1}{2\pi\sqrt{LC}} \tag{1}$$

where L is the inductance of the first winding 81 of the transformer 80, and C is the equivalent capacitance of the lamp 50 and the capacitor 75.

The second switching signal $S_2$ is enabled once the second control signal $V_2$ is higher than the first threshold $V_{T1}$. After a quarter resonant period of the resonant circuit, the second switching signal $S_2$ is disabled once the second control signal $V_2$ is lower than the second threshold $V_{T2}$.

FIG. 9 shows the first control circuit 100 or the second control circuit 200 according to an embodiment of the present invention. A first input resistor 130 and a second input resistor 140 are coupled to the transformer 80 to receive a control signal $V_X$ (the first control signal $V_1$ or the second control signal $V_2$). A first current source 110 and a second current source 120 are coupled to the first input resistor 130 and the second input resistor 140, respectively. The input resistors 130, 140 and the current sources 110, 120 provide level shifting for the control circuit to detect the control signal $V_X$. The resistance of the input resistors 130 and 140 are equal. The current of the second current source 120 is higher than that of the first current source 110. Therefore the voltage generated at the second input resistor 140 is higher than the voltage generated at the first input resistor 130, in which the differential voltage in between the first input resistor 130 and the second input resistor 140 determines the first threshold $V_{T1}$. A third current source 115 is coupled to the second input resistor 140 via a control switch 116. A first comparator 170 has an input coupled to the first input resistor 130. Another input of the first comparator 170 is connected to the first input resistor 130 through a delay circuit. The delay circuit is formed by a resistor 150 and a capacitor 155. An output of the first comparator 170 turns on/off the control switch 116. When the magnitude of the control signal $V_X$ is reduced, the first comparator 170 will output a logic-high signal to turn on the control switch 116 and connect the third current source 115 to the second input resistor 140. The second current source 120 associated with the third current source 115 generate a higher voltage at the second input resistor 140, which determines the second threshold $V_{T2}$ in FIG. 8. Therefore, the second threshold $V_{T2}$ is higher than the first threshold $V_{T1}$. A second comparator 180 has an input coupled to the first input resistor 130. Another input of the second comparator 180 is connected to the second input resistor 140. A switching signal $S_X$ (the first switching signal $S_1$ or the second switching signal $S_2$) is enabled in response to an output of the second comparator 180. In order to improve the noise immunity, a debounce circuit 190 is coupled to the output of the second comparator 180 for generating the switching signal $S_X$.

FIG. 10 shows the debounce circuit according to an embodiment of the present invention, in which a current source 310 and a capacitor 330 determine a first debounce period while a logic-low input transits to a logic-low output. A current source 315 and the capacitor 330 determine another debounce period while a logic-high input transits to a logic-high output.

Since the first switch 10 and the second switch 20 are turned off before the energy of the resonant circuit is fully discharged, the energy is able to generate the circular current to turn on the first diode 11 and the second diode 21. Besides, the switching of the switches 10 and 20 can be detected by the polarity change of the control signals $V_1$ and $V_2$. The first switch 10 is turned on immediately after the first diode 11 is conducted, and the second switch 20 is turned on immediately after the second diode 21 is conducted. Therefore, soft switching operation is achieved and the efficiency of the ballast is improved.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A switching circuit for a ballast, comprising:

a resonant circuit, formed by a capacitor and a transformer connected in series to operate a lamp, wherein said transformer has a first winding connected in series with said lamp, and a second winding and a third winding of said transformer respectively generate a first control signal and a second control signal in response to a switching current of said resonant circuit;

a first switch, coupled to said resonant circuit to supply a first voltage to said resonant circuit, wherein said first switch is controlled by a first switching signal;

a second switch, coupled to said resonant circuit to supply a second voltage to said resonant circuit, wherein said second switch is controlled by a second switching signal;

a first control circuit, coupled to generate said first switching signal in response to said first control signal; and a second control circuit, coupled to generate said second switching signal in response to said second control signal.

2. The switching circuit as claimed in claim 1, wherein said first switching signal is enabled once said first control signal is higher than a first threshold, and after a quarter resonant period of said resonant circuit, said first switching signal is disabled once said first control signal is lower than a second threshold.

3. The switching circuit as claimed in claim 1, wherein said second switching signal is enabled once said second control signal is higher than a first threshold, and after a quarter resonant period of said resonant circuit, said second switching signal is disabled once said second control signal is lower than a second threshold.

4. The switching circuit as claimed in claim 1, wherein said first control circuit comprises:

a first input resistor and a second input resistor, coupled to said transformer;

a first current source and a second current source, coupled to said first input resistor and said second input resistor respectively;

a third current source, coupled to said second input resistor via a control switch;

a first comparator, having an input coupled to said first input resistor, another input of said first comparator being connected to said first input resistor via a delay circuit, and an output of said first comparator being coupled to turn on/off said control switch; and a second comparator, having an input coupled to said first input resistor, another input of said second comparator being connected said second input resistor, wherein said first switching signal is enabled in response to an output of said second comparator.

5. The switching circuit as claimed in claim 4, wherein said first control circuit further comprises a debounce circuit coupled to generate said first switching signal.

6. The switching circuit as claimed in claim 1, wherein said second control circuit comprises:

a first input resistor and a second input resistor, coupled to said transformer;

a first current source and a second current source, coupled to said first input resistor and said second input resistor respectively;

a third current source, coupled to said second input resistor via a control switch;

a first comparator, having an input coupled to said first input resistor, another input of said first comparator being connected to said first input resistor via a delay circuit, and an output of said first comparator being coupled to turn on/off said control switch; and a second comparator, having an input coupled to said first input resistor, another input of said second comparator being connected to said second input resistor, wherein said second switching signal is enabled in response to an output of said second comparator.

7. The switching circuit as claimed in claim 6, wherein said second control circuit further comprises a debounce circuit coupled to generate said second switching signal.

8. A ballast circuit, comprising:

a resonant circuit, having a transformer connected in series with a lamp to operate said lamp, wherein said transformer has a first winding connected in series with said lamp, and a second winding and a third winding of said transformer generate a first control signal and a second control signal respectively in response to a switching current of said resonant circuit;

a first switch, coupled to said resonant circuit to supply a first voltage to said resonant circuit, wherein said first switch is controlled by a first switching signal;

a second switch, coupled to said resonant circuit to supply a second voltage to said resonant circuit, wherein said second switch is controlled by a second switching signal;

a first control circuit, coupled to generate said first switching signal in response to said first control signal; and a second control circuit, coupled to generate said second switching signal in response to said second control signal.

9. The ballast circuit as claimed in claim 8, wherein said first switching signal is enabled once said first control signal is higher than a first threshold, and after a quarter resonant period of said resonant circuit, said first switching signal is disabled once said first control signal is lower than a second threshold; said second switching signal being enabled once said second control signal being higher than said first threshold, and after the quarter resonant period of said resonant circuit, said second switching signal being disabled once said second control signal being lower than a second threshold.

10. The ballast circuit as claimed in claim 8, wherein said first control circuit comprises:

a first input resistor and a second input resistor, coupled to said transformer;

a first current source and a second current source, coupled to said first input resistor and said second input resistor, respectively;

a third current source, coupled to said second input resistor via a control switch;

a first comparator, having an input coupled to said first input resistor, and another input of said first comparator being connected to said first input resistor via a delay circuit, wherein an output of said first comparator is coupled to turn on/off said control switch; and a second comparator, having an input coupled to said first input resistor, and another input of said second comparator being connected to said second input resistor, wherein said first switching signal is enabled in response to an output of said second comparator.

11. The ballast circuit as claimed in claim 10, wherein said first control circuit further comprises a debounce circuit coupled to generate said first switching signal.

12. The ballast circuit as claimed in claim 8, wherein said second control circuit comprises:

a first input resistor and a second input resistor, coupled to said transformer;

a first current source and a second current source, coupled to said first input resistor and said second input resistor, respectively;

a third current source, coupled to said second input resistor via a control switch;

a first comparator, having an input coupled to said first input resistor, and another input of said first comparator being connected to said first input resistor via a delay circuit, wherein an output of said first comparator is coupled to turn on/off said control switch; and a second comparator, having an input coupled to said first input resistor, and another input of said second comparator being connected to said second input resistor, wherein said second switching signal is enabled in response to an output of said second comparator.

13. The ballast circuit as claimed in claim 12, wherein said first control circuit further comprises a debounce circuit coupled to generate said second switching signal.

* * * * *